US009004019B2

(12) United States Patent
Huang et al.

(10) Patent No.: US 9,004,019 B2
(45) Date of Patent: Apr. 14, 2015

(54) WATER HEATER

(71) Applicant: Grand Mate Co., Ltd., Taichung (TW)

(72) Inventors: Chung-Chin Huang, Taichung (TW); Chin-Ying Huang, Taichung (TW); Hsin-Ming Huang, Taichung (TW); Hsing-Hsiung Huang, Taichung (TW); Kuan-Chou Lin, Taichung (TW); Yen-Jen Yeh, Yunlin (TW)

(73) Assignee: Grand Mate Co., Ltd., Taichung (TW)

( * ) Notice: Subject to any disclaimer, the term of this patent is extended or adjusted under 35 U.S.C. 154(b) by 206 days.

(21) Appl. No.: 13/776,976

(22) Filed: Feb. 26, 2013

(65) Prior Publication Data

US 2014/0150733 A1 Jun. 5, 2014

(30) Foreign Application Priority Data

Dec. 3, 2012 (TW) ..... 101145303 A

(51) Int. Cl.
*F22B 21/30* (2006.01)
*F24H 1/14* (2006.01)
*F28D 1/00* (2006.01)

(52) U.S. Cl.
CPC . *F24H 1/145* (2013.01); *F28D 1/00* (2013.01)

(58) Field of Classification Search
USPC ..... 122/235.22, 235.23, 235.32, 275, 355, 122/358, 32, 33, 31.1
See application file for complete search history.

(56) References Cited

U.S. PATENT DOCUMENTS

| | | | | |
|---|---|---|---|---|
| 589,553 | A * | 9/1897 | Stiff | 122/40 |
| 879,502 | A * | 2/1908 | Van Oosterwyck | 122/235.19 |
| 2,200,156 | A * | 5/1940 | Cassidy | 122/355 |
| 4,282,861 | A * | 8/1981 | Roark | 126/610 |
| 4,422,411 | A * | 12/1983 | Thorogood | 122/7 R |
| 4,576,121 | A * | 3/1986 | Thorogood | 122/7 R |
| 4,628,870 | A * | 12/1986 | Draper et al. | 122/32 |
| 4,726,353 | A * | 2/1988 | Clawson | 122/18.4 |
| 5,394,837 | A * | 3/1995 | Tsai et al. | 122/235.23 |
| 6,237,545 | B1 * | 5/2001 | Barnett et al. | 122/235.23 |
| 6,852,294 | B2 * | 2/2005 | Doerksen | 422/200 |
| 7,137,360 | B1 * | 11/2006 | Zorzit | 122/235.11 |
| 7,464,671 | B2 * | 12/2008 | Harth, III | 122/510 |
| 8,567,352 | B2 * | 10/2013 | Kaupp | 122/235.23 |
| 8,573,161 | B2 * | 11/2013 | Min | 122/31.1 |
| 8,635,976 | B2 * | 1/2014 | Gayheart et al. | 122/510 |
| 2014/0299074 | A1 * | 10/2014 | Nor | 122/260 |

* cited by examiner

*Primary Examiner* — Gregory A Wilson
(74) *Attorney, Agent, or Firm* — Ming Chow; Sinorica, LLC

(57) ABSTRACT

A water heater includes a water pipe form by bending a pipe. The entire water pipe leans related to a vertical plane to expose all the section to a burner thereunder. All the sections of the water pipe lean downwards related to a horizontal plane. It will make the water in the water in the water pipe flows backwards when no water is supplied to the water heater. Therefore, there will never be water remaining in the water pipe to get rid of the jam problem.

7 Claims, 8 Drawing Sheets

WATER HEATER

The current application claims a foreign priority to the patent application of Taiwan No. 101145303 filed on Dec. 3, 2012.

BACKGROUND OF THE INVENTION

1. Field of the Invention

The present invention relates generally to a water heater, and more particularly to a water heater having an integrated water pipe.

2. Description of the Related Art

FIG. 1 and FIG. 2 show a conventional water heater, which has a housing 12, a burner 14, a plurality of heat exchange plates 16, and a water pipe 18. The housing 12 has a combustion chamber 122 therein and a heat exchange chamber 124 above the combustion chamber 122. The burner 14 is received in the combustion chamber 122, and the heat exchange plates 16 and the water pipe 18 are received in the heat exchange chamber 124. The heat exchange plates 16 are arranged in vertical and parallel. The water pipe 18 is a continuous S-shaped tube, having a plurality of straight tubes 182 and U tubes 184. The straight tubes 182 are parallel and transversely pass through the heat exchange plates 16, and the U tubes 184 are connected to ends of the straight tubes 182 by welding. This kind of water heater has the following drawbacks:

1. There might be a leakage at junctions of the straight tubes 182 and the U tubes 184 because of unsuccessful welding.

2. After of long time of use, there might be material fatigue because of repeated thermal expansion and shrink, especially at the welding portions. It may cause leakage as well.

3. The U tubes 184 are left out of the heat exchange chamber 124, so that heat might be dissipated via the U tubes 184. It reduces the heat efficiency.

4. There will be water staying in the straight tubes 182 when the water heater does not work. In wintertime, the water might freeze to cause the water pipe 18 jammed. It will make the water heater malfunction when ice jams the water pipe 18.

SUMMARY OF THE INVENTION

The primary objective of the present invention is to provide a water heater without the leakage problem of the water pipe and having low cost and high quality.

According to the objective of the present invention, the present invention provides a water heater, including a housing having a room therein; a burner received in the room of the housing; a water pipe received in the room of the housing and above the burner, wherein the water pipe is formed by bending a pipe into a continuous S-shape to have a plurality of straight sections and U sections, and the U sections are connected to ends of the neighboring straight sections respectively; and a plurality of heat exchange plates engaging the water pipe.

In an embodiment, the water pipe leans related to a vertical plane, and the straight sections leans downwards relative to a horizontal plane.

Therefore, the water pipe in the present invention is formed from single pipe, so that no further process is needed except bending. It may reduce the cost of manufacture and get rid of the leakage problem.

DETAILED DESCRIPTION OF THE INVENTION

Figure 1:
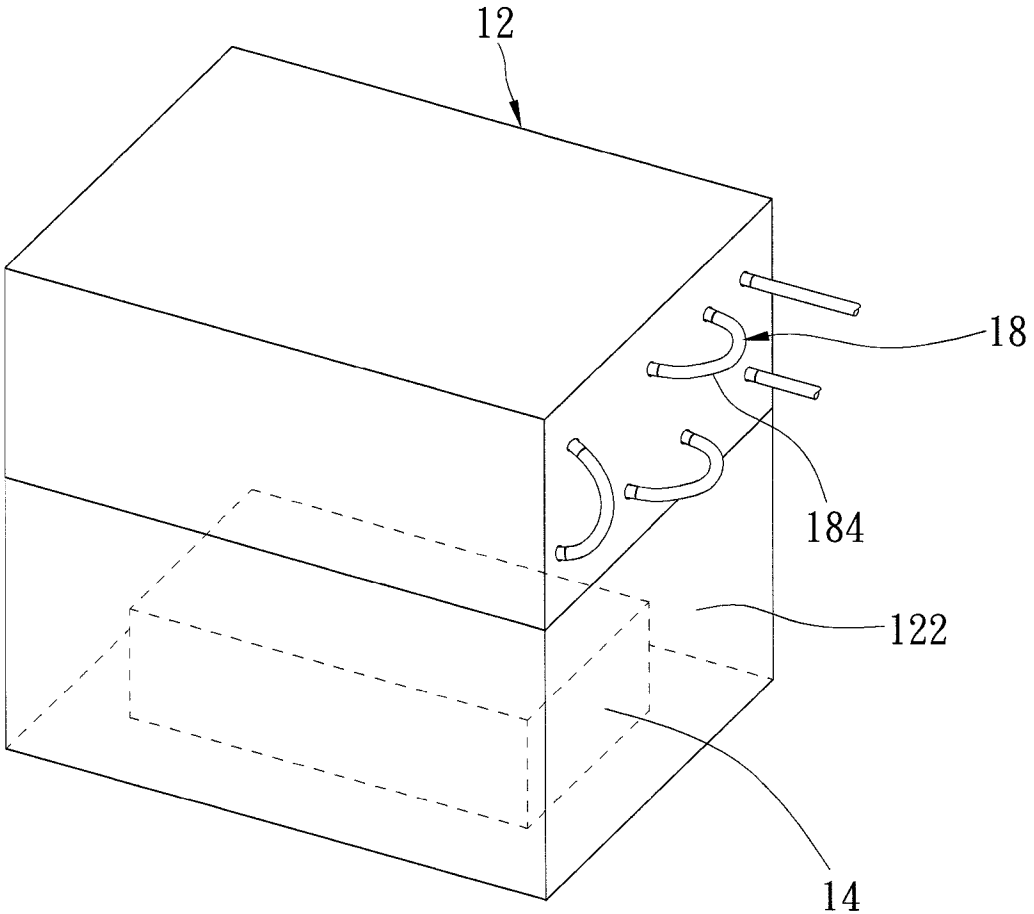
FIG. 1 (PRIOR ART)
FIG. 1 is a perspective view of the conventional water heater.
Figure 2:
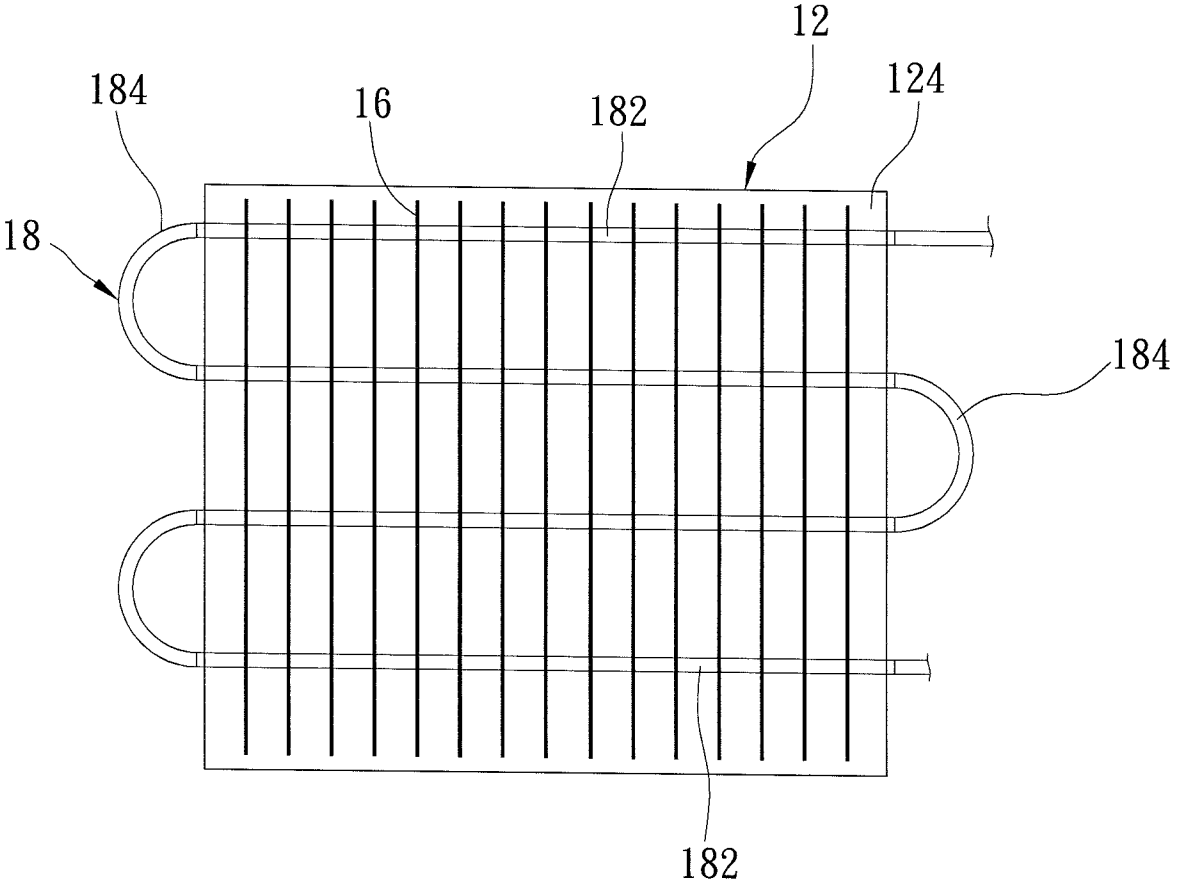
FIG. 2 (PRIOR ART)
FIG. 2 is a perspective view of the water pipe and the heat exchange plates of the conventional water heater.
Figure 3:
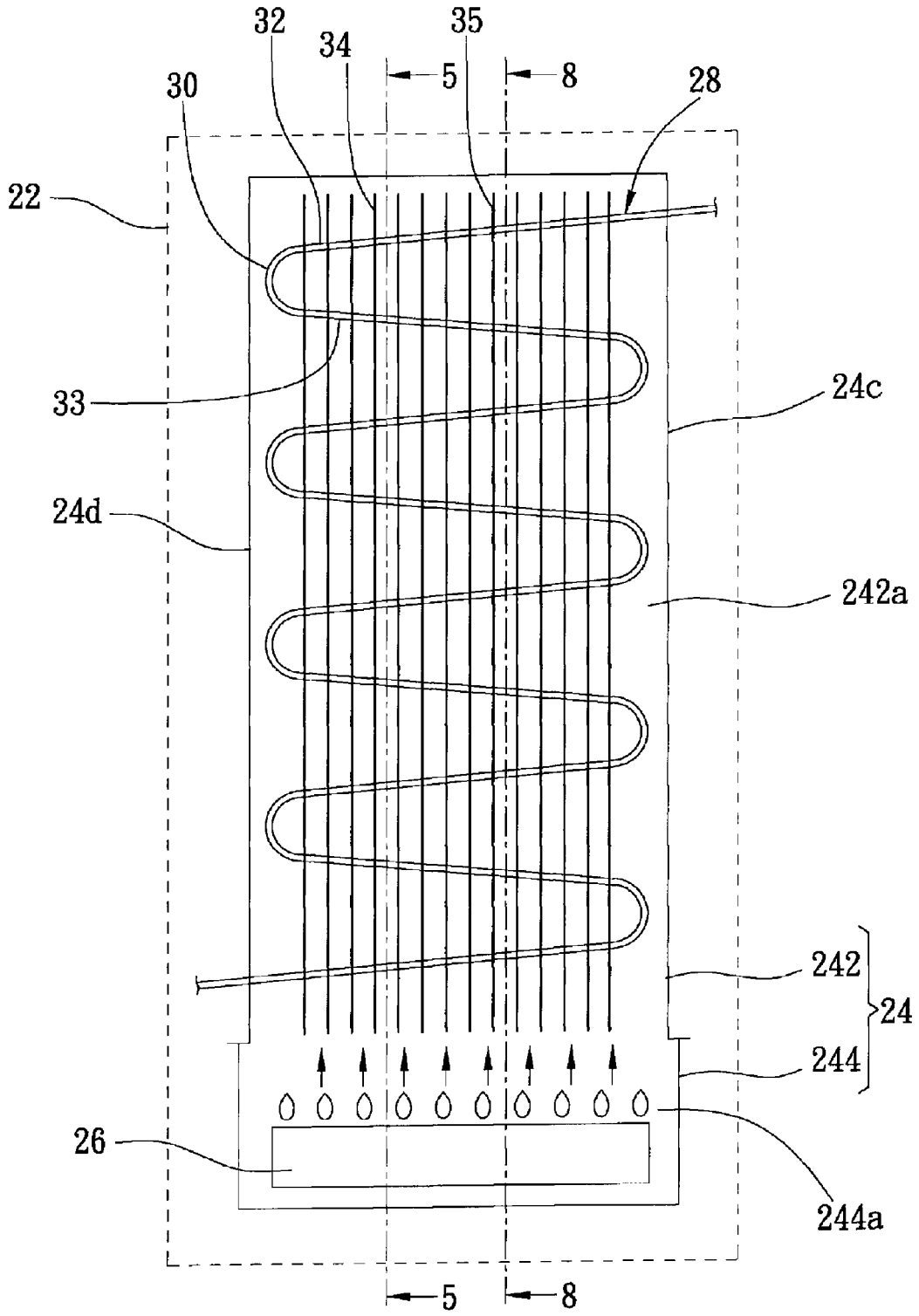
FIG. 3 is a sketch diagram of a preferred embodiment of the present invention.
Figure 4:
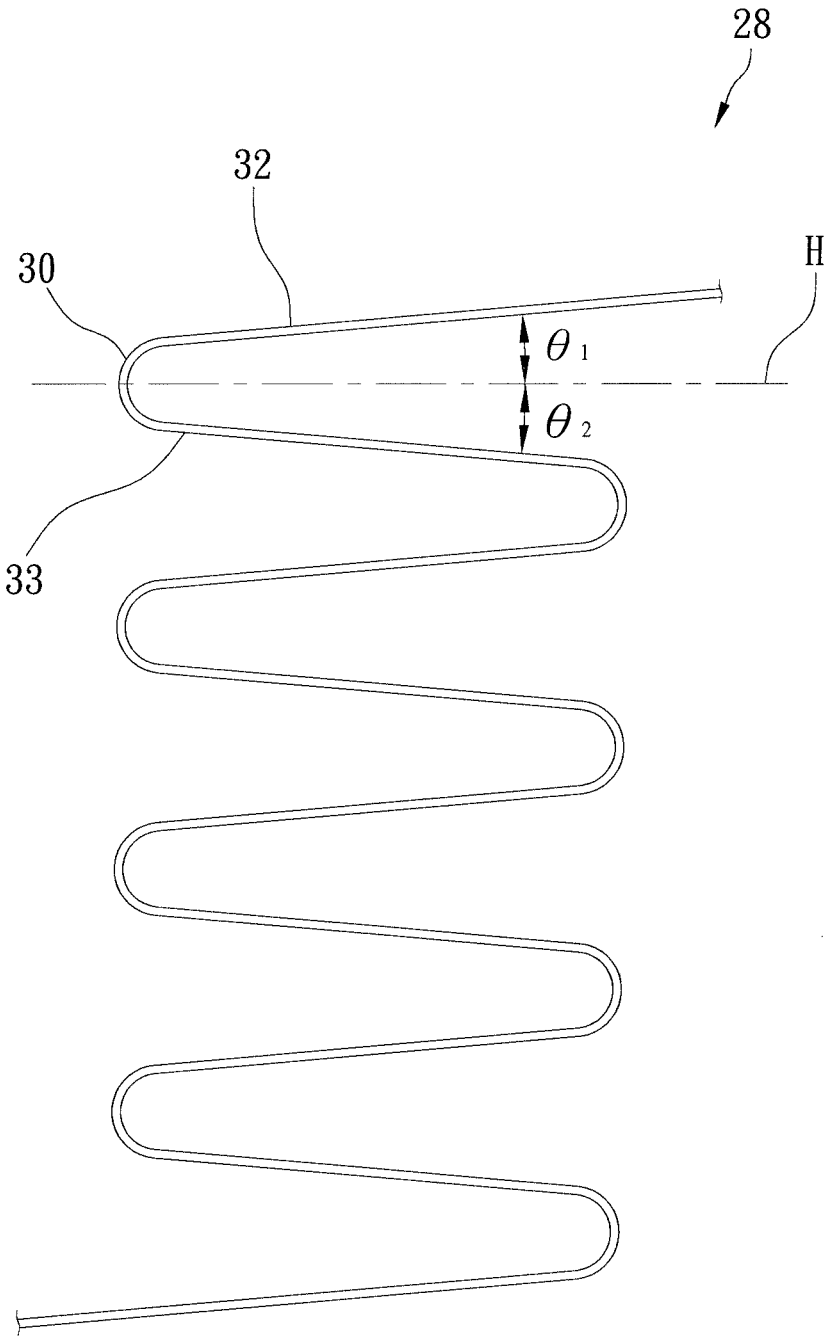
FIG. 4 is a perspective view of the water pipe of the preferred embodiment of the present invention.

The detailed description and technical contents of the present invention will be explained with reference to the accompanying drawings. However, the drawings are illustrative only but not used to limit the present invention.

As shown in FIGS. from FIG. 3 to FIG. 8, a water heater of the preferred embodiment of the present invention includes a casing 22, a housing 24, a burner 26, a water pipe 28, and a plurality of heat exchange plates 34, 35.

The housing 24 is received in the casing 22. In an embodiment, the housing 24 is rectangular member having a room therein. The housing 24 has a first side 24*a* at a front, a second side 24*b* at a rear, a third side 24*c* at a right, and a fourth side 24*d* at a left. The housing 24 is assembled from an up housing 242 and a low housing 244. A heat exchange chamber 242*a* is formed in the up housing 242, and a combustion chamber 244*a* is formed in the low housing 244.

The burner 26 is received in the combustion chamber 244*a* of the housing 24. In an embodiment, the burner 26 is a gas burner which burns gas to generate flames.

The water pipe 28 is received in the heat exchange chamber 242*a* of the housing 24. The water pipe 28 is a continuous S-shaped pipe formed by bending a pipe, having a plurality of straight sections 32, 33 and U sections 30. The straight sections include alternate first straight sections 32 and second straight sections 33. The first straight sections 32 are parallel to each other, and the second straight sections 33 are parallel to each other, but the first straight sections 32 are not parallel to the second straight sections 33. Each U sections 30 is connected to ends of the first and the second straight sections 32, 33, and is at the ends where the first and the second straight sections 32, 33 are closer. In other words, the U sections 30 will not overlapped at any vertical level. It makes each of the first and the second straight sections 32, 33 lean downwards from a higher U section 30 to the next U section 30. The first straight sections 32 extend downwards from the third (right) side 24*c* to the fourth (left) side 24*d*, and the second straight sections 33 extend downwards from the fourth (left) side 24*d* to the third (right) side 24*c*. In precisely, the first straight section 32 has an angle θ1 above a horizontal plane H, and the second straight section 33 has an angle θ2 under a horizontal plane H. In an embodiment, the angles θ1 and θ2 are preferred in a range between 3 degrees and 10 degrees. As a result, water will flow backwards from the top end of the water pipe 28 to the bottom end thereof without any water remained in the water pipe 28 while no water is supplied to the water heater.

Figure 5:
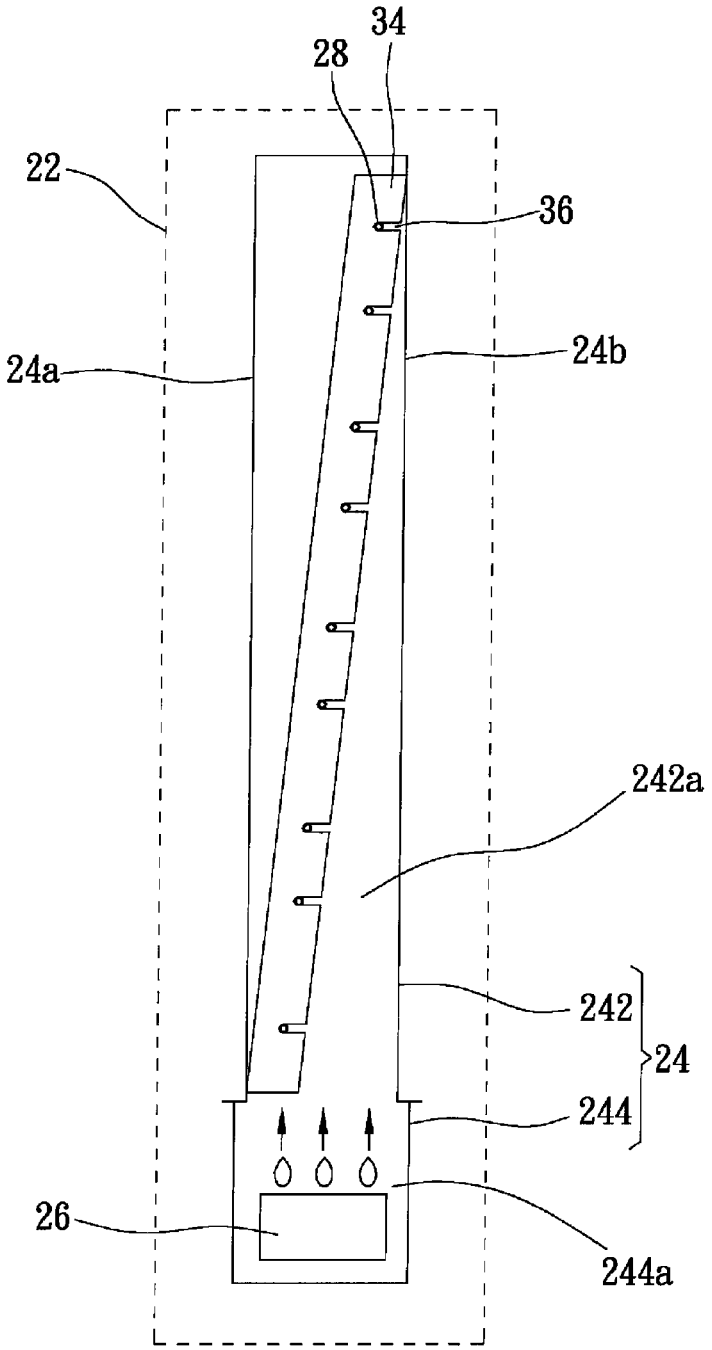
FIG. 5 is a sectional view along the 5-5 line in FIG. 3, showing the first heat exchange plate.

As shown in FIG. 5, the entire water pipe 28 also leans related to a vertical plane. In an embodiment, a top end of the water pipe 28 is adjacent to the second (rear) side 24*b* of the housing 24, and a bottom end thereof is adjacent to the first (front) side 24*a*. It will directly expose all the straight sections 32, 33 to the burner 26.

Figure 8:
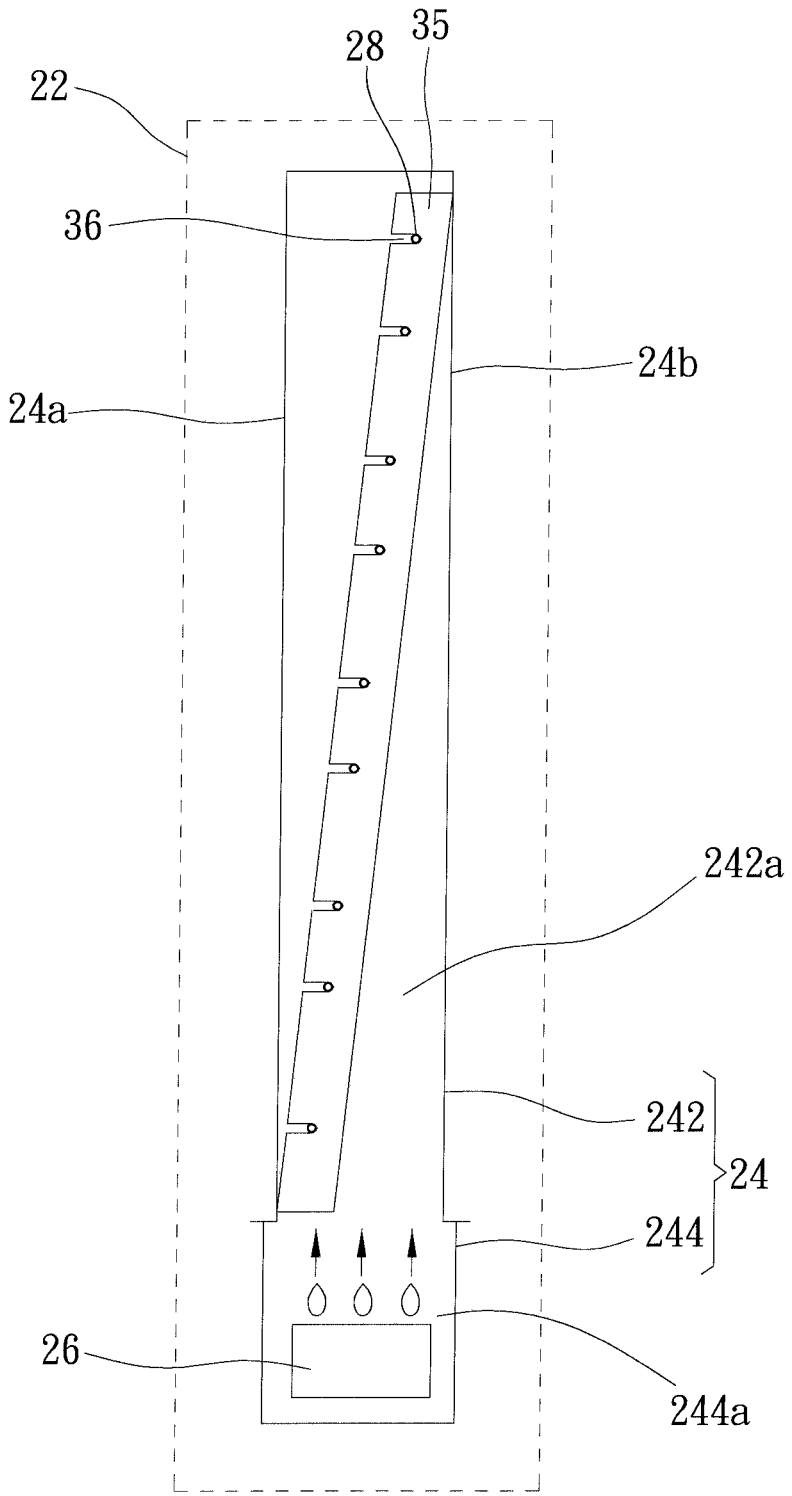
FIG. 8 is a sectional view along the 8-8 line in FIG. 3, showing the second heat exchange plate.

The heat exchange plates includes first exchange plates 34 and second exchange plates 35, which are vertical and parallel to each other. The first and the second heat exchange plates 34, 35 alternately engage the water pipe 28. Each of the first exchange plates 34 has slots 36 which are opened at a side facing the second (rear) side 24*b* (FIG. 5), and each of the second exchange plates 35 has slots 36 which are opened at a side facing the second (front) side 24*a* (FIG. 8). The first exchange plates 34 engage the water pipe 28 via a side of the water pipe 28 to have the straight sections 32, 33 received in the slots 36, and the second exchange plates 35 engage the water pipe 28 via the other side to have the straight sections 32, 33 received in the slots 36.

Figure 6:
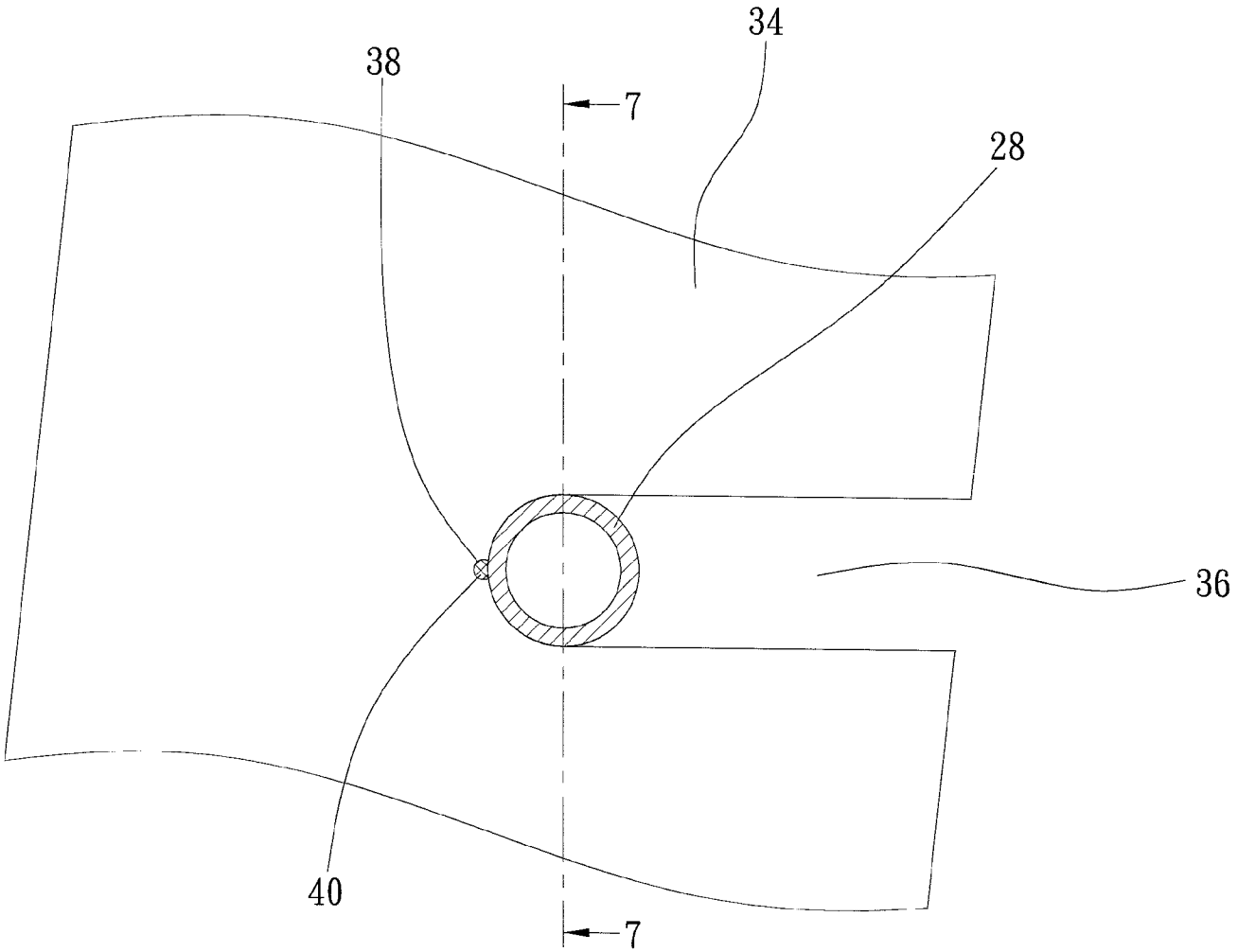
FIG. 6 is an enlarged view of FIG. 5, showing the engagement of the water pipe and the first heat exchange plate.
Figure 7:
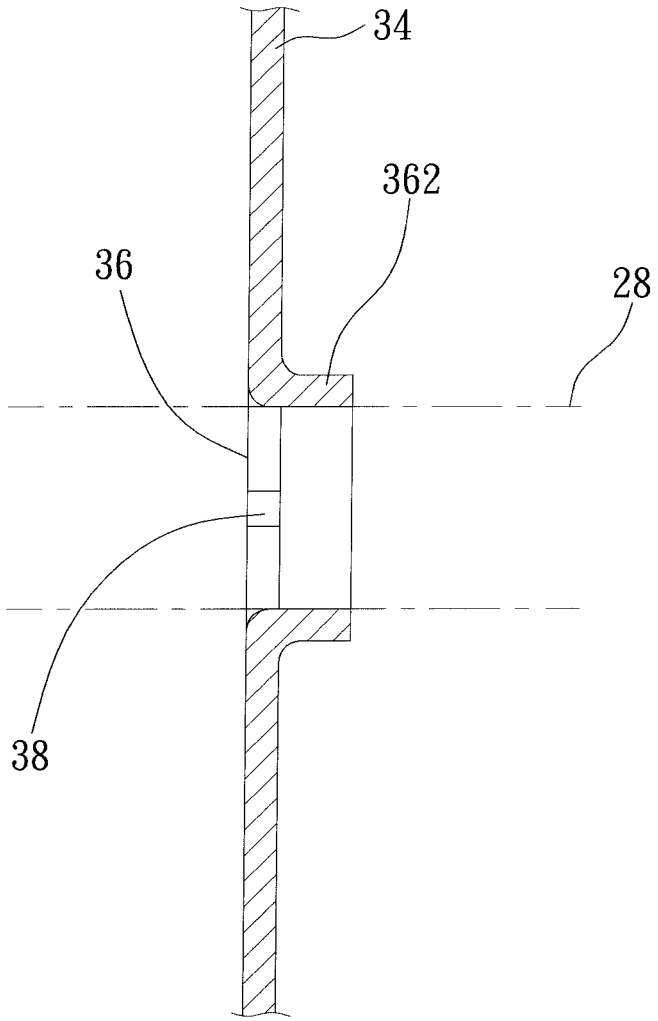
FIG. 7 is a sectional view along the 7-7 line in FIG. 6, showing the flange of the heat exchange plate.

As shown in FIG. 6, each heat exchange plate 34, 35 further is provided with a recess 38 on an edge of the slot 36. Each recess 38 is received with a thermal conductor 40 in contact with the water pipe 28. The thermal conductor 40 has a heat transfer coefficient higher than the heat exchange plate 34, 35 to quickly transfer heat from the heat exchange plate 34, 35 to the water pipe 28. In an embodiment, the thermal conductor 40 is a solder pad. As shown in FIG. 7, each heat exchange plate 34, 35 further has a flange 362 around the slot 36. The flange 362 is a bent portion of the heat exchange plate 34, 35 to increase a contacting area between the heat exchange plate 34, 35 and the water pipe 28.

While the burner 26 in the combustion chamber 224*a* generates heat to heat air, and the hot air directly goes to the heat exchange chamber 242*a*. The heat will transferred to the water pipe 28 directly or through the heat exchange plate 34, 35 to heat the water in the water pipe.

The water pipe 28 is formed from single pipe, so that no further process is needed except bending. It may reduce the cost of manufacture and get rid of the leakage problem. Furthermore, the entire water pipe is received in the heat exchange chamber, including the U sections, therefore, the heat will remain in the heat exchange chamber to heat water.

Besides, the leaning water pipe may directly expose all the straight sections to the burner that may help the heat transfer. All the straight sections of the water pipe lean downwards to make the water flows backwards when no water is supplied to the water heater. Therefore, there will never be water remaining in the water pipe to get rid of the jam problem.

The description above is a few preferred embodiments of the present invention, and the equivalence of the present invention is still in the scope of claim construction of the present invention.

What is claimed is:

1. A water heater, comprising:

a housing having a room therein;

a burner received in the room of the housing;

a water pipe received in the room of the housing and above the burner, wherein the water pipe is formed by bending a pipe into a continuous S-shape to have a plurality of straight sections and U sections, and the U sections are connected to ends of the neighboring straight sections respectively;

a plurality of heat exchange plates engaging the water pipe;

each of the heat exchange plates has a plurality of slots to engage the straight sections of the water pipe;

each of the heat exchange plates has a flange around the slot to be in contact with the water pipe; and each of the heat exchange plates has a recess on an edge of the slot, and a thermal conductor is received in the recess to contact the water pipe.

2. The water heater as defined in claim 1, wherein the housing has a first side and a second side, which is opposite to the first side, and a top end of the water pipe is adjacent to the first side and a bottom end of the water pipe is adjacent to the second side so that the water pipe leans related to a vertical plane.

3. The water heater as defined in claim 1, wherein the straight sections includes a plurality of first straight sections and a plurality of second straight sections in alternate connection; the first straight sections are not parallel to the second straight sections; and the first straight sections and second straight sections lean downwards related to a horizontal plane.

4. The water heater as defined in claim 3, wherein angles between the first straight sections and the horizontal plane are in a range between 3 degrees and 10 degrees.

5. The water heater as defined in claim 3, wherein angles between the second straight sections and the horizontal plane are in a range between 3 degrees and 10 degrees.

6. The water heater as defined in claim 1, wherein the heat exchange plates has a plurality of first heat exchange plates and a plurality of second heat exchange plates; the first heat exchange plates and the second heat exchange plates respectively engage the water pipe via opposite sides of the water pipe to have the water pipe received in the slots respectively.

7. The water heater as defined in claim 6, wherein the first heat exchange plates and the second heat exchange plates are in an alternate arrangement.

* * * * *